US008308313B2

(12) United States Patent
Wakalopulos

(10) Patent No.: US 8,308,313 B2
(45) Date of Patent: Nov. 13, 2012

(54) JET DRIVEN ROTATING ULTRAVIOLET LAMPS FOR CURING FLOOR COATINGS

(75) Inventor: George Wakalopulos, Pacific Palisades, CA (US)

(73) Assignee: Adastra Technologies, Inc., Torrance, CA (US)

( * ) Notice: Subject to any disclaimer, the term of this patent is extended or adjusted under 35 U.S.C. 154(b) by 831 days.

(21) Appl. No.: 12/478,970

(22) Filed: Jun. 5, 2009

(65) Prior Publication Data

US 2009/0272320 A1 Nov. 5, 2009

Related U.S. Application Data

(63) Continuation-in-part of application No. 12/209,080, filed on Sep. 11, 2008, now Pat. No. 7,731,379, and a continuation-in-part of application No. 12/112,753, filed on Apr. 30, 2008, now Pat. No. 7,775,690.

(60) Provisional application No. 61/098,602, filed on Sep. 19, 2008.

(51) Int. Cl.
*F21V 33/00* (2006.01)

(52) U.S. Cl. ..... 362/92; 362/230; 362/234; 118/642; 250/504 R; 427/508; 427/558

(58) Field of Classification Search ..... 118/642, 118/643; 250/504 R, 493.1; 362/92, 96, 362/230, 234, 253; 427/508, 558
See application file for complete search history.

(56) References Cited

U.S. PATENT DOCUMENTS

| | | | | |
|---|---|---|---|---|
| 2,777,091 | A | 1/1957 | Rixton | |
| 4,070,398 | A | 1/1978 | Lu | |
| 4,105,118 | A | 8/1978 | Williams, Jr. et al. | |
| 4,701,766 | A | 10/1987 | Sugitani et al. | |
| 5,003,185 | A | 3/1991 | Burgio, Jr. | |
| 5,259,169 | A | 11/1993 | Appelbaum et al. | |
| 6,361,194 | B1 | 3/2002 | Evans et al. | |
| 6,538,258 | B1 * | 3/2003 | Rau et al. | 250/504 R |
| 6,571,953 | B2 | 6/2003 | Sherline et al. | |
| 6,716,305 | B2 | 4/2004 | Green et al. | |
| 6,739,716 | B2 | 5/2004 | Richards | |
| 6,761,127 | B2 | 7/2004 | Field et al. | |
| 6,783,263 | B1 | 8/2004 | Cronk | |
| 6,953,940 | B2 | 10/2005 | Leighley et al. | |
| 7,344,272 | B2 | 3/2008 | Cooper et al. | |
| 2003/0178928 | A1 | 9/2003 | Becker et al. | |
| 2004/0027075 | A1 | 2/2004 | Hataoka et al. | |
| 2004/0071891 | A1 | 4/2004 | Luka | |
| 2004/0251849 | A1 | 12/2004 | Harada | |
| 2008/0030115 | A1 | 2/2008 | Erofeev et al. | |

FOREIGN PATENT DOCUMENTS

| | | |
|---|---|---|
| JP | 20000-65999 | 3/2000 |

* cited by examiner

*Primary Examiner* — Stephen F Husar

(74) *Attorney, Agent, or Firm* — Schneck & Schneck; Thomas Schneck

(57) ABSTRACT

A machine for applying ultraviolet light to curable coatings on floors and other wide area surfaces. A housing encloses rotating arms carrying UV lamps spinning about a central axis. Rotation is caused by reactive momentum from heated air jets coming from fans in barrels blowing air over heated wires, resembling hand held hair dryers, with the barrels supported under rotating arms. The heated wires are ballast for the lamps, providing thermal and electrical stability. The rotating lamps cover an annular pattern which, when advanced forwardly, becomes a linear swath, almost as wide as the housing. A floor, or similar surface, can be cured in a few minutes.

20 Claims, 5 Drawing Sheets

JET DRIVEN ROTATING ULTRAVIOLET LAMPS FOR CURING FLOOR COATINGS

CROSS-REFERENCE TO RELATED APPLICATIONS

This application claims priority from provisional application Ser. No. 61/098,602 filed Sep. 19, 2008 for Rotating UV Source for Wide Area Curing and is a continuation-in-part of application Ser. No. 12/209,080 filed Sep. 11, 2008, now U.S. Pat. No. 7,731,379, and application Ser. No. 12/112,753 filed Apr. 30, 2008, now U.S. Pat. No. 7,775,690, all by George Wakalopulos.

TECHNICAL FIELD

The invention relates to apparatus for applying radiant energy to coating materials, and in particular to applying ultraviolet (UV) energy to coatings on floors.

BACKGROUND OF THE INVENTION

Beams of high intensity UV light are useful for curing polymers in certain coatings, such as paints, inks adhesives and the like. Such coatings are often used to treat large surface areas, such as floors and so there is a need to cure coatings on such surface areas with UV light. U.S. Pat. No. 6,761,127 describes apparatus for curing floor coatings using two UV lamps at different wavelengths with energy applied in a linear stripe pattern. This apparatus is said to be limited to no more than 75 watts per inch.

More power density is useful for faster curing. In prior patent application Ser. No. 12/209,080 filed Sep. 11, 2008, G. Wakalopulos described how a known reliable source of UV light at good power is a mercury vapor street light. Typical power is 175 watts per inch available a few minutes after starting. At start-up a small pool of mercury is vaporized and heated. The lamp is a negative resistance device requiring ballast to prevent increasing current from damaging the lamp. The negative resistance is offset by a positive impedance that tends to limit current. As the lamp heats up during operation, internal gas pressure rises and a higher voltage is required to maintain the discharge. The resistive drop across the ballast supplies the required voltage until the required voltage cannot be supplied to maintain the discharge. At that point, the discharge is extinguished, the lamp cools, the gas pressure is reduced and the ballast is again effective once the lamp is started. An auxiliary high voltage electrode is used to restart the arc discharge. Such power in a UV lamp would be desirable for curing floor coatings if heat and electrical stability problems could be solved with appropriate ballast in a convenient radiant energy delivery system adapted for surfaces such as floors. If heat and electrical stability problems are not solved, the lamp fails.

SUMMARY OF THE INVENTION

The present invention deploys ultraviolet lamps of the kind found in street lamps on radially extending arms about an axial support shaft. There are two problems. A first problem is to focus the light onto the floor in an efficient high intensity beam. A second problem is to provide thermal and electrical ballast to the lamp to prevent lamp failure.

The first problem is solved in an embodiment using a U-shaped channel housing that is a shell supporting shiny spars that form a reflector for an elongated lamp tube placed between the spars at a focal location. The lamp tube axis is parallel to the arm. A gap between the spars allows air flow between spars to cool the lamp.

The second problem is more difficult and is solved in an embodiment using a Nichrome wire of the type found in a common hair dryer, providing resistive ballast. Air is blown across the heated wire in a path that takes hot air past the lamp. The reflector is vented so that air can enter a plenum defined by the reflector wherein the lamp is mounted. When the lamp is cold, heated air passing over the resistive wire heats the lamp toward a desired operating temperature. When the lamp temperature exceeds the temperature of the heated wire the air cools the lamp tending to stabilize thermal performance.

Circulation of hot air is established by air jets coming from fans in tubes that resemble hair dryer barrels. The barrels are aligned transverse to the arms like jets engines on aircraft wings to provide circumferential reactive momentum to arms on which they are mounted, similar to other arms mounting the lamps, all rotating about the same axis. Thus the barrels provide jet momentum that rotates the arms about the axis as well as air that regulates the lamps also being rotated by the jet momentum. As lamp temperature increases, voltage across the lamp increases, causing increased fan speed increasing jet momentum thereby cooling the lamp, lowering voltage, and lowering jet momentum. In this manner, the lamp achieves ballast while jet momentum alternates between two values.

In summary, elongated UV lamps of the type commonly used as street lamps, mounted on freely rotating arms, trace an annular pattern on a floor. As a spindle or shaft, carrying the arms, is advanced, a wide swath of a floor is treated. Hot air from a blower is used for thermal stabilization of the lamps. It may also be used to rotate the arms by reactive momentum transfer.

DETAILED DESCRIPTION

Figure 1:
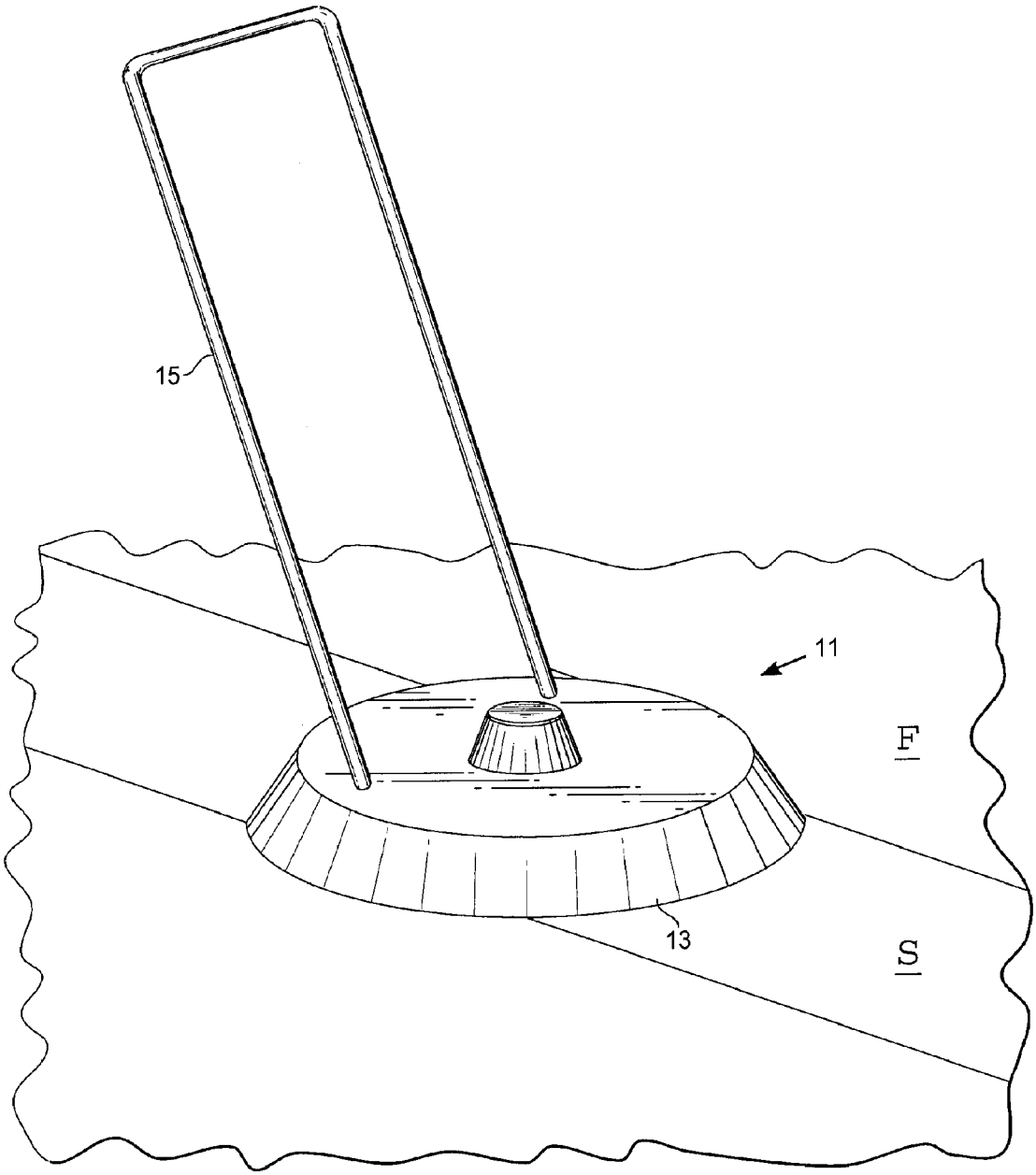
FIG. 1 is a perspective view of a machine for applying ultraviolet radiant energy to coatings on a floor in accordance with the invention.

With reference to FIG. 1, a machine 11 cures a coating on floor, F, using UV light sources in housing 13. The machine sweeps a swath, S, that is almost as wide as housing 13. Because lamps within the housing rotate, edge effects are minimal. The machine has small rollers that allow the housing 13 to easily move over the floor when pushed by handle 15.

Figure 2:
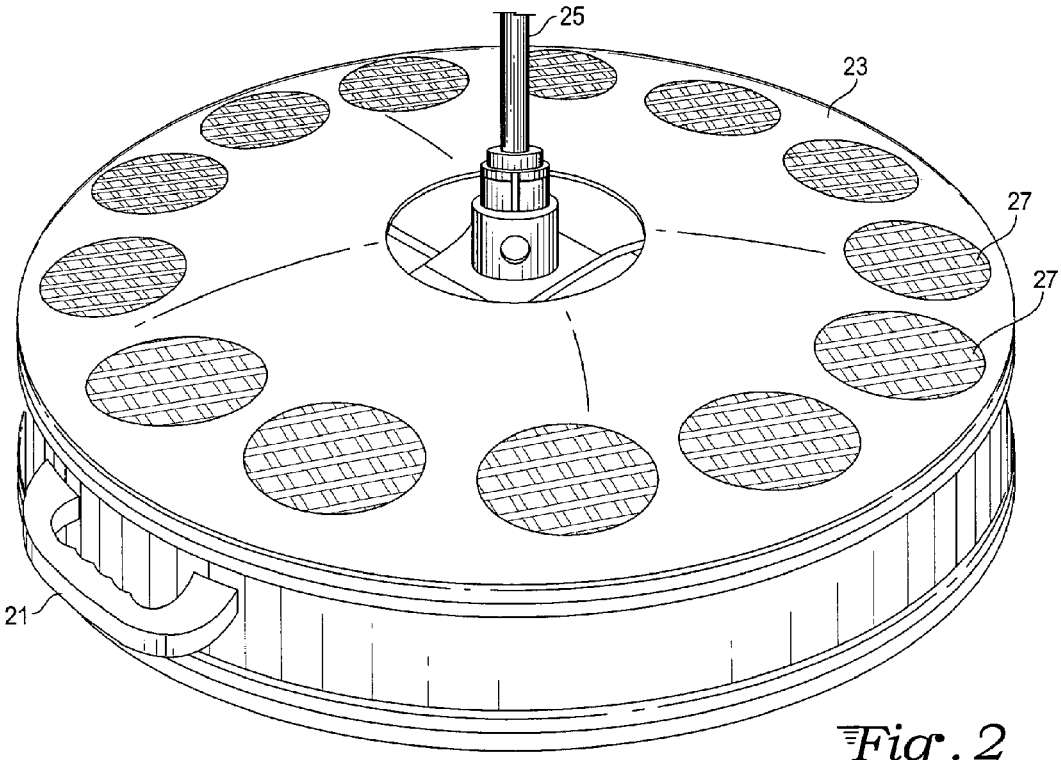
FIG. 2 is a top perspective view of an embodiment of a machine similar to the apparatus of FIG. 1.

In FIG. 2, a hand movable version of the machine of FIG. 1 is shown with a housing 23, a handle 21, a central axial shaft 25 and a plurality of vent ports 27 allowing the escape of hot air from blowers described below. Housing 23 also moves on wheels or rollers as described above.

Figure 3:
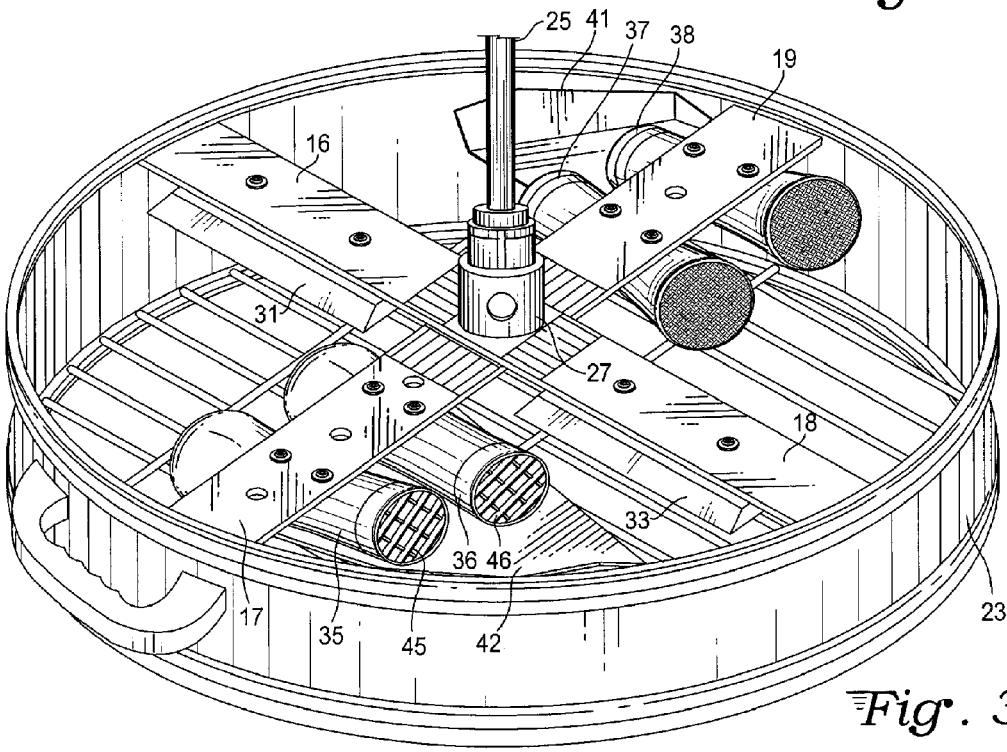
FIG. 3 is a top perspective view of the machine of FIG. 2 with top cover removed.

With reference to FIG. 3, housing 23 is seen to have arms 16, 17, 18, and 19 connected to collar 27 that freely rotates about a supporting axial shaft 25. The arms 16-19 extend radially outwardly from the shaft and rotate about it. Arm 16 supports an elongated UV lamp within reflector 31. The lamp and reflector are axially parallel to arm 16 although this is not required. The lamp has a length that is coextensive with most of the length of the supporting arm. This permits most of the diameter of housing 23 to be effective in creating a curing footprint for the apparatus similar to the swath, S, shown in FIG. 1. Of course, to create the swath another UV lamp with reflector 33 is used in tandem, with UV lamps opposite each other. Reflector 33 is carried by arm 18 diametrically opposed to arm 16. The reflectors, lamps, and arms are mirror images of each other about shaft 25. In rotation, the lamps sweep an annular pattern. However, as the annular pattern of illumination is advanced, a swath or stripe pattern is illuminated. A housing would typically have a diameter of 28 inches with a swath 24 inches wide. This allows 24 inch stripes of a coating on a floor to be cured by UV light by slowly advancing the housing over a floor coated with a UV light curable coating. There should be some overlap between adjacent stripes to avoid any edge effects and to avoid untreated gaps.

Perpendicular, or at least transverse, to arms 16 and 18 are arms 17 and 19. Arm 17 carries a pair of blowers 35 and 36. Similarly, arm 19 carries a pair of blowers 37 and 38. The blowers are similar in size, appearance, and performance to the barrels of hand held hair dryers. Each blower has a Nichrome heating wire inside of the barrel across which air is blown by a motor driven fan or cage. Hot air emerges from the barrel. Other electronics associated with the Nichrome wire are also in the barrel. When the UV lamps are at relatively low temperature compared to their ideal operating temperature, air heated by being blown across the Nichrome wire heats the lamps by convection associated with rotation of the arms. When the temperature of the lamps exceeds the ideal operating temperature, air blown across the wire, at the same temperature as described above, now cools the lamps because the lamps are hotter than the hot air. In this manner the lamp operating temperature is stabilized. It is seen that the preferred operating temperature for air heated by the Nichrome wire is equal to the ideal operating temperature of the lamps. Since the Nichrome wire operates by resistive heating, similar to a toaster, the amount of resistance of the wire is adjusted to achieve the desired air heating. This can either be established at the time of manufacture by calibration or an electronic feedback system having a temperature sensor and variable resistance controller can be used. Without temperature stabilization, many lamps would fail.

Each of the blowers has a exit port for heated air. The exit ports 45, 46 are associated with respective blowers 35, 36. The air exit ports for blowers 37, 38 cannot be seen because they face in an opposite direction but have the effect of complementing the reactive momentum of the other blowers. The blowers are mounted below respective support arms, like jet engines mounted below an aircraft wing. Just like jet engines, the blowers establish reactive momentum that propels the arms causing the collar 27 to rotate about axial shaft 25. In FIG. 3, the direction of rotation would be clockwise rotation. Some of the heated air is blown toward deflector 41 and 42 that direct heated air out of the housing 23 allowing less resistance to the reactive momentum of the blowers. The deflectors are bent pieces of sheet metal mounted to each arm that carries blowers.

Figure 4:
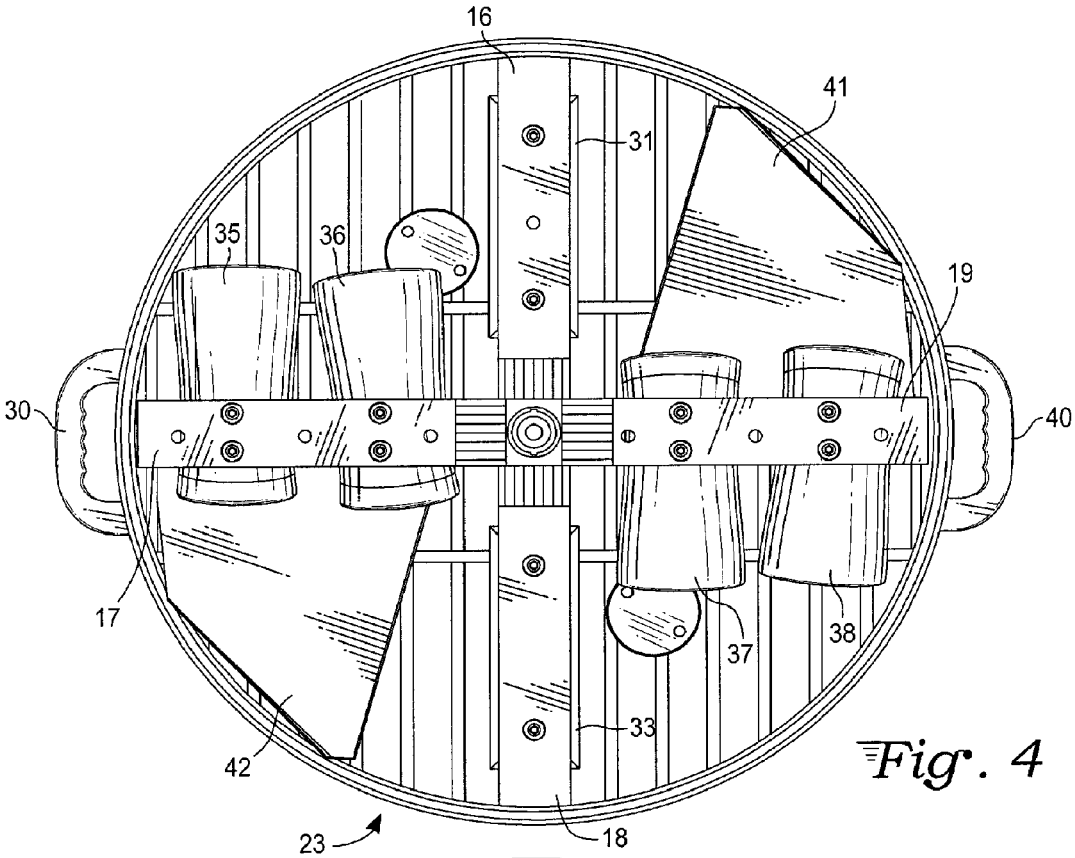
FIG. 4 is a top view of the machine of FIG. 2 with top cover removed.

In FIG. 4, the deflectors 41 and 42 are seen from the top with the cover of the housing 23 removed. Deflected air is directed upwardly through ports in the cover of the housing while some of the heated air rushes past lamps within reflectors 31, 33 carried by arms 16 and 18 respectively. Note that housing 23 has handles 30, 40 to move the housing by hand over a surface.

Figure 5:
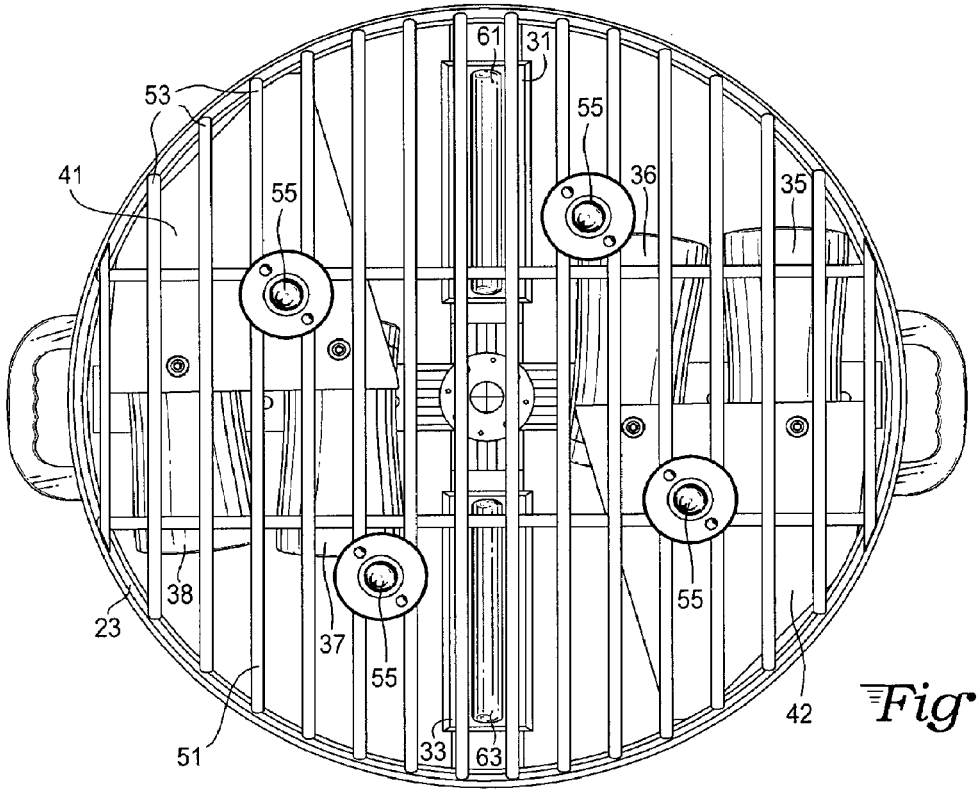
FIG. 5 is a bottom view of the machine of FIG. 2 with top cover removed.

In FIG. 5, housing 23 has a protective grill 51 with parallel ribs 53 that support rollers 55. The rollers may be roller bearings or wheels. Grill 51 is sufficiently open to a support surface, such as a floor, so that radiation from lamps 61 and 63 within respective reflectors 31 and 33, can reach the support surface. The distance from the lamps to the support surface is only a few inches. The lamps spin at a variable rate as the reactive momentum from blowers 35-38 drives the arms of the device about the center collar and axial shaft. The blowers include a barrel having a fan driven by a motor and a resistively heated wire in front of the fan to heat air blown out of the barrel.

Figure 6:
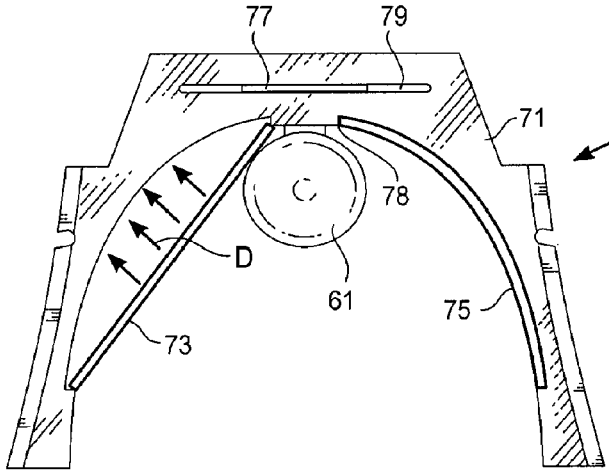
FIG. 6 is an end view of a beam forming reflector structure for use in the machine shown in FIG. 1.

In FIG. 6 a reflection 31 for a UV lamp 61 is seen to have a rib 71 which is one of a number of parallel, spaced apart identical ribs. The ribs support lengthwise shiny metal spars 73, 75 that are thin, elongated metal strips that flex and can be bent to assume the shape of the ribs. The ribs have an internal parabolic shape. Flexing of a spar is indicated by arrows, D, such that spar 73 assumes the shape of the spar 75. A further reflective element can be a shiny metal slot 77 placed in a slot 79 in a position between proximate ends of spars 73 and 75 near the internal vertex of the parabolic reflector. If UV lamp 61 has an axis aligned with the focal line of the elongated parabolic reflector formed by the ribs, spars, and slots, then UV light will emerge from the reflector as a beam.

Figure 7:
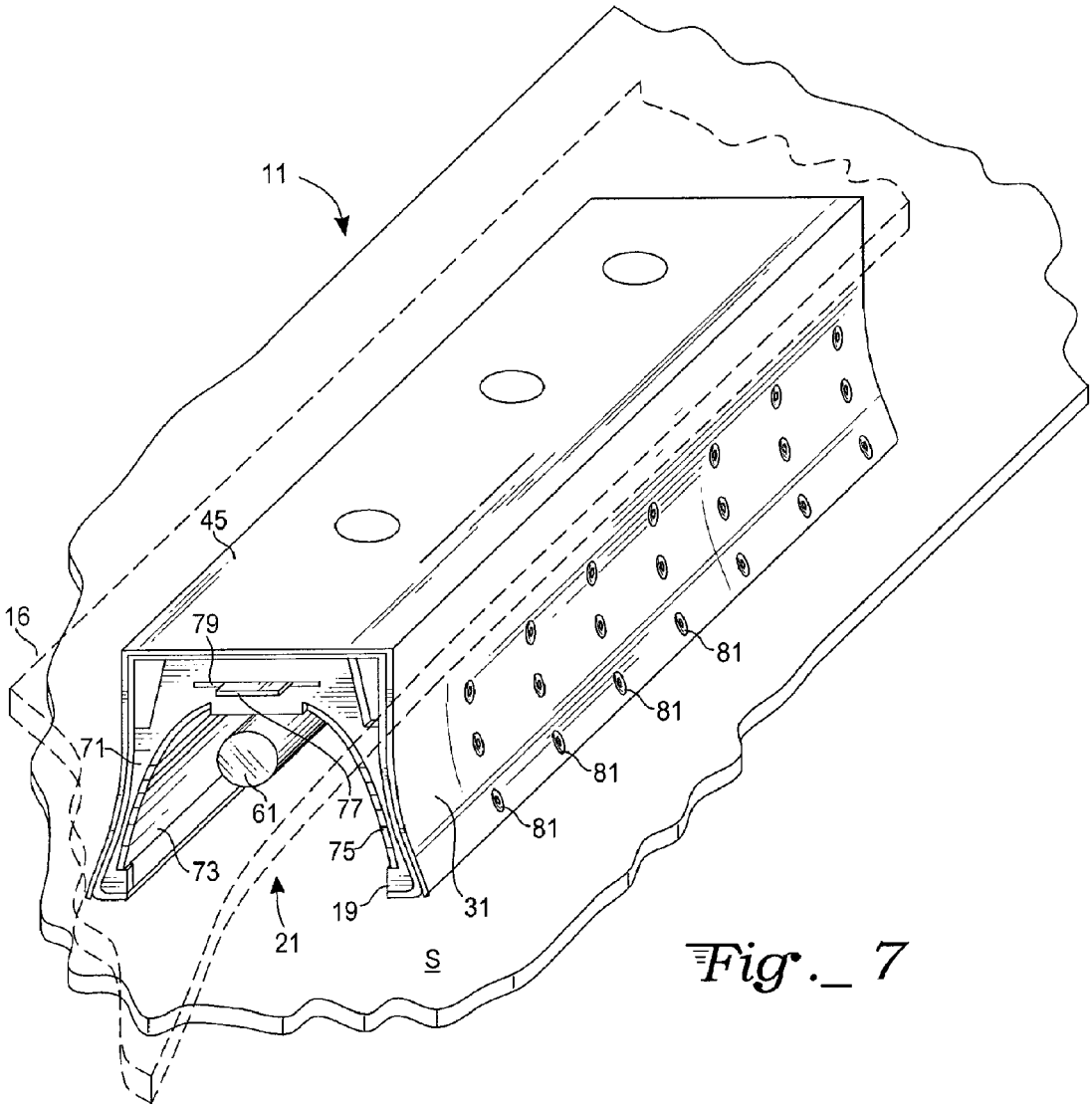
FIG. 7 is a perspective view of a beam forming reflector structure for use in the machine shown in FIG. 1.

In FIG. 7, reflector 31 is seen to be an elongated structure that carries a UV lamp 61 that is a mercury vapor street lamp. The lamp 61 is axially mounted at or near the focus of a parabolic reflector 31 formed by the shiny metal spars and the shiny metal slot 77 in slat 79. The spars are held in place by a series of parallel ribs including a first rib 71. Positions of other ribs are identified by fasteners 81 holding the ribs in place. Arm 16 is seen supporting the reflector 31.

Figure 8:
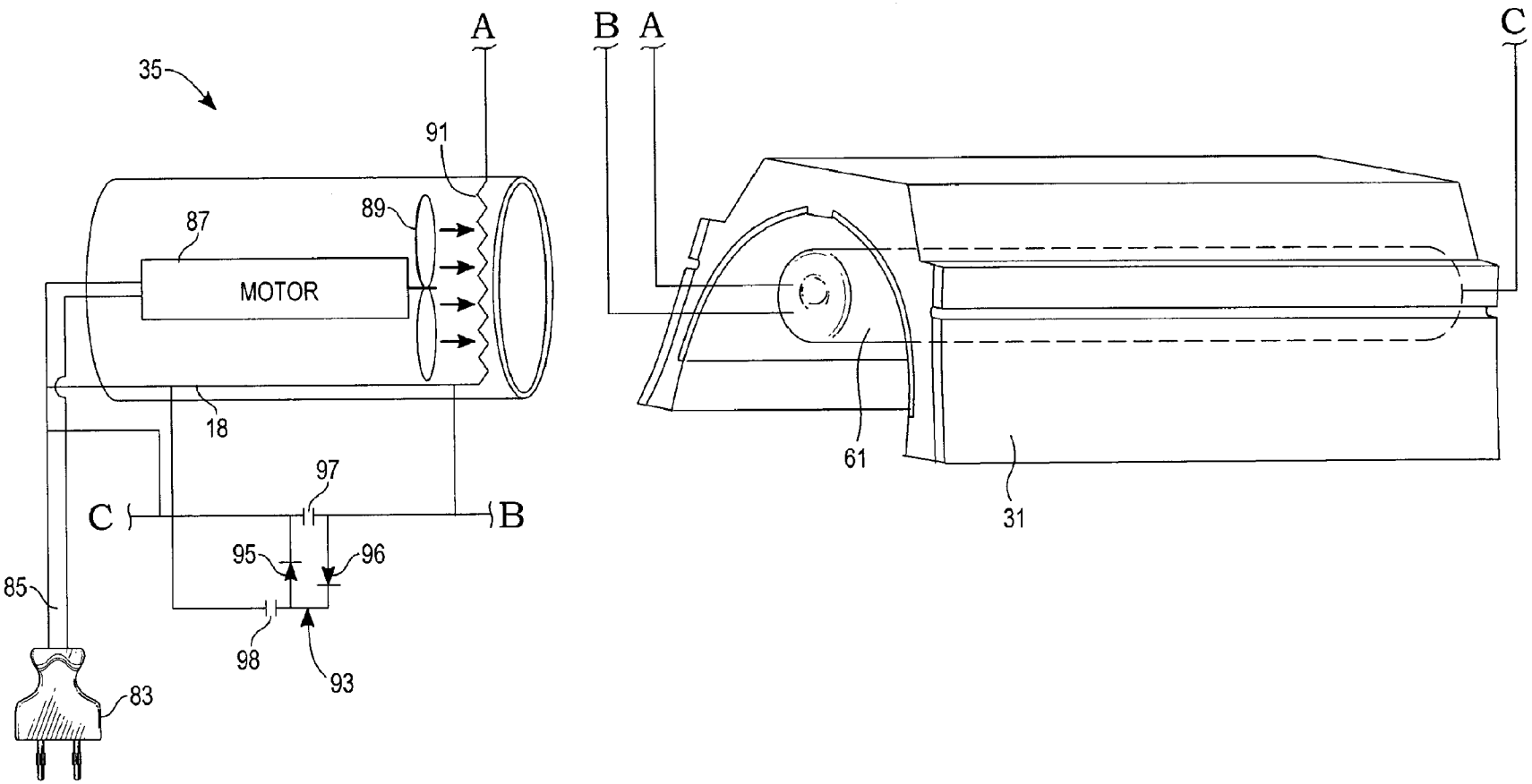
FIG. 8 is an electrical plan for the machine shown in FIG. 1.

FIG. 8 shows electrical relationships of the blower and lamp members shown in FIGS. 3-5. Blower 35 has an electrical connection to an AC plug 83 that has a pair of wires 85 connected to AC motor 87 which drives fan 89. Wires 85 are also connected to the UV lamp 61 within reflector 31 by means of electrodes A, B, and C. Separating the contacts between electrodes A and B is a ballast resistor 91 which is a Nichrome wire of the type found in hair dryers and toasters and described above. Fan 89 directs air, indicated by arrows, through the Nichrome wires and towards the lamp 61 within the housing. Electrodes A and B of the lamp are connected to a voltage multiplier circuit 93 which serves as a starter for the lamp. Diodes 95 and 96 are oppositely biased at opposite plates of a first capacitor 97 while a second capacitor 98 forms a quasi-bridge circuit for voltage multiplication. The circuit draws little current but high voltage from the circuit allows ignition of a material such as molten mercury within the lamp which will form an ionic plasma in lamp tube 61. The ballast resistor 91 is used to counteract the negative resistance of the mercury vapor ultraviolet lamp 61. The ballast resistor 91 prevents the lamp from drawing excessive current and provides electrical stability as the lamp warms. However, the temperature of the lamp will exceed the temperature of the hot air being blown across it from heating of the ballast resistor. As the lamp continues to heat up during operation, internal gas pressure within the lamp tube causes a higher voltage to be required to maintain the arc discharge. The higher voltage is not available through the ballast circuit. Since the voltage necessary to maintain the arc exceeds the voltage provided by the electrical ballast, the arc fails. The lamp momentarily goes out and begins to cool down. As gas pressure in the tube goes down, liquid mercury will form and the high voltage multiplier circuit 93 can be used to ignite the arc and send current into ballast resistor 91, plus generate heat from the Nichrome wire resistor 91 blown by the fan toward the lamp. This heats the lamp causing the lamp to glow and produce infrared light once again. This on-off cycle is inherent in the performance of the lamp and allows relatively high intermittent power to be obtained from a simple circuit. The fan also generates reactive momentum causing rotation of the arms carrying the lamps. As the lamps rotate, they trace an annular pattern where intense UV light energy has been delivered. As the housing is advanced along a line, the annular pattern becomes a stripe pattern. This allows a coating on a floor to be cured by a succession of parallel stripes where intense UV light has been delivered. The invention is not limited to use on floors but could be used on any area. For example, in graffiti removal from walls such as on box cars, curable coatings are often used. The hand held version of the present invention, shown in FIG. 2, could be used to cure coatings.

What is claimed is:

1. An apparatus for curing ultraviolet light curable coatings comprising:

an axial shaft supporting radially extending rotating arms; and at least one ultraviolet lamp mounted on one of the arms for rotation and at least one blower mounted on another of the arms, whereby the blower provides reactive momentum for rotating the arms about the shaft thereby causing circumferential rotation of the lamp about the shaft.

2. The apparatus of claim 1 further comprising a housing enclosing the rotating arms.

3. The apparatus of claim 2 further comprising a housing having an upper side and a lower side, the lower side having rollable members contacting a surface having a curable coating.

4. The apparatus of claim 2 wherein the rotating arms are crossing arms centered on the axial shaft for circumferential rotation, with one crossing arm supporting one lamp on each side of the shaft and another arm supporting one air expelling blower on each side of the shaft, the blowers on opposite sides of the shaft oriented to expel air in the same circumferential direction, the jet momentum of the expulsion rotating the arms.

5. The apparatus of claim 2 wherein the rotating arms are crossing arms centered on the axial shaft for circumferential rotation, with one crossing arm supporting two lamps, one lamp on each side of the shaft, and another arm supporting two air expelling blowers, one blower on each side of the shaft, the blowers on opposite sides of the shaft oriented to expel air in the same circumferential direction.

6. The apparatus of claim 2 wherein each blower has an air nozzle and a deflector associated with the nozzle whereby air exiting the nozzle encounters the deflector.

7. The apparatus of claim 1 wherein each ultraviolet lamp is an elongated lamp having an axis aligned with an arm.

8. The apparatus of claim 4 wherein a first crossing arm supports a pair of ultraviolet lamps on opposite sides of the shaft and a second crossing arm supports a pair of blowers on opposite sides of the shaft.

9. The apparatus of claim 8 wherein the second crossing arm supports two pair of blowers, with one pair of blowers on an opposite side of the shaft from another pair of blowers.

10. The apparatus of claim 7 wherein each elongated lamp has an elongated reflective housing of parabolic cross sectional shape forming a ultraviolet light beam, whereby rotation of each elongated lamp causes beam rotation sweeping an annular swath of light from said arms.

11. The apparatus of claim 1 wherein the axial shaft is rotationally driven by a motor.

12. The apparatus of claim 11 wherein the motor is associated with a housing enclosing the rotating arms, the housing having opposed major sides including a first side facing curable coating that is open between members supporting rollable members contacting a surface having a curable coating.

13. The apparatus of claim 12 wherein the housing has a second side having vents.

14. An apparatus for curing ultraviolet light curable coatings comprising:

an axial shaft supporting radially extending rotating arms; and at least one ultraviolet lamp mounted on one of the arms for rotation.

15. The apparatus of claim 14 further comprising at least one blower mounted on another of the arms whereby the blower provides reactive momentum for rotating the arms about the shaft.

16. An apparatus for curing ultraviolet light curable coatings comprising:

a housing having rollers spaced apart for motion over a support surface, the housing being at least partially open in the direction of the support surface;

a plurality of rotating arms within the housing supported by a shaft at least partially within the housing; and at least one ultraviolet lamp mounted on one of the arms for rotation and at least one blower mounted on another of the arms, whereby the blower provides reactive momentum for rotating the arms about the shaft thereby causing circumferential rotation of the lamp about the shaft.

17. The apparatus of claim 16 wherein the rotating arms are crossing arms centered on the axial shaft for circumferential rotation, with one crossing arm supporting one lamp on each side of the shaft and another arm supporting one air expelling blower on each side of the shaft, the blowers on opposite sides of the shaft oriented to expel air in the same circumferential direction, the jet momentum of the expulsion rotating the arms.

18. The apparatus of claim 16 wherein the rotating arms are crossing arms centered on the axial shaft for circumferential rotation, with one crossing arm supporting two lamps, one lamp on each side of the shaft, and another arm supporting two air expelling blowers, one blower on each side of the shaft, the blowers on opposite sides of the shaft oriented to expel air in the same circumferential direction.

19. The apparatus of claim 16 wherein each blower has an air nozzle and a deflector associated with the nozzle whereby air exiting the nozzle encounters the deflector.

20. The apparatus of claim 16 wherein each ultraviolet lamp is an elongated lamp having an axis aligned with an arm.

* * * * *